US005299873A

United States Patent [19]

Miebori

[11] Patent Number: 5,299,873

[45] Date of Patent: Apr. 5, 1994

[54] CARRIAGE POSITION CONTROL CIRCUIT FOR A SERIAL PRINTER

[75] Inventor: Takao Miebori, Niigata, Japan

[73] Assignee: NEC Corporation, Tokyo, Japan

[21] Appl. No.: 77,038

[22] Filed: Jun. 16, 1993

[30] Foreign Application Priority Data

Jun. 16, 1992 [JP] Japan ..... 4-156623

[51] Int. Cl.[5] ..... B41J 21/16

[52] U.S. Cl. ..... 400/279; 400/708; 400/705.1

[58] Field of Search ..... 400/279, 624, 322, 708, 400/320, 705, 705.1

[56] References Cited

U.S. PATENT DOCUMENTS

| | | | |
|---|---|---|---|
| 4,061,595 | 7/1986 | Aiba et al. | 400/705.1 |
| 4,265,556 | 5/1981 | Krieg et al. | 400/705.1 |
| 4,272,204 | 6/1981 | Quinn, Jr. et al. | 400/705.1 |
| 4,781,478 | 11/1988 | Eguchi | 400/279 |
| 5,127,752 | 7/1992 | Courtney | 400/705.1 |

*Primary Examiner*—David A. Wiecking
*Assistant Examiner*—John S. Hilten
*Attorney, Agent, or Firm*—Sughrue, Mion, Zinn, Macpeak & Seas

[57] ABSTRACT

A carriage position control circuit which locates a carriage at a center position of a printing sheet regardless of the paper size to maintain the printing sheet in contact with the platen. The carriage position control circuit includes a sensor (30) which moves, together with the carriage (2), in parallel to a center axis of the platen (1) of a serial printer and senses a printing sheet (10), a sheet position detector (43) which detects left and right edge positions of the printing sheet based on the sensor output and a center position calculating circuit (45) which calculates the center position of the printing sheet based on the left and right edge positions. The detection of the left and right edge positions and the calculation of the center position are performed before the leading edge of the printing sheet reach the anti-floating device (3). The line feed controller (46) controls a line feed and a carriage moving controller (47) controls the movement of the carriage according to the center position data calculated by the center position calculating circuit (45). Therefore, the carriage can be reliably moved to the center position of the printing sheet even if the width of the printing sheet is very narrow compared with the length of the platen.

10 Claims, 6 Drawing Sheets

CARRIAGE POSITION CONTROL CIRCUIT FOR A SERIAL PRINTER

BACKGROUND OF THE INVENTION

1. Field of the Invention

The present invention relates to a serial printer including a platen and a carriage having a printing head secured thereto, and more particularly, to a carriage position control circuit for use in the serial printer for positioning the carriage and the printer.

2. Description of the Related Art

A conventional dot impact serial printer includes a platen and a carriage having a printing head secured thereto. Such a printer is usually provided with an anti-floating device for preventing a printing sheet from being raises from the platen. During printing, the printing sheet is fed by the platen to a first gap between the platen and the carriage and then transferred to a second gap between the platen and the anti-floating device. When printing near the leading edge of the printing sheet, the leading edge is initially positioned close to the head of the carriage. Therefore, the leading edge does not extend to the anti-floating device. As a result, when the serial printer first begins a line feed operation the sheet tends to be raised from the platen since the leading edge of the sheet has not yet reached the anti-floating device.

In order to prevent the sheet from raising in this manner, the carriage is moved to a center position of the platen regardless of the width of the sheet in an effort to maintain the sheet in contact with the platen.

In such conventional serial printer, when the width of the sheet is considerably small as compared to the length of the platen and the sheet is offset to the right or left side of the platen, the centrally positioned carriage is laterally displaced from the sheet. Therefore, the sheet floats away or raises from the platen. If a line feed operation is performed while the sheet is raised from the platen, the sheet will be fed in a skewed manner, a leading edge of the printing sheet will be obstructed by an edge of the anti-floating device or the sheet will be soiled during the printing operation.

In order to solve this problem, there has recently been introduced a serial printer including a non-volatile memory which stores positioning data indicating the proper positioning of the carriage for each size of the printing sheets prior to printing or line feeding. However, the operator must frequently change operating modes of the printer so that appropriate positioning data may be read from the memory in accordance with the paper size of the sheet. Moreover, the use of the printer is restricted to paper sizes that are stored in the memory.

SUMMARY OF THE INVENTION

An object of the invention is to provide a carriage position control circuit which locates a carriage at a center position of a printing sheet regardless of the paper size to maintain the printing sheet in contact with the platen.

Another object of the invention is to provide a serial printer which utilizes the carriage position control circuit permitting the use of any size paper.

The carriage position control circuit has a sensor for sensing the presence of a printing sheet initially set on the platen, a detector for detecting left and right lateral edge positions of the printing sheet, calculating circuit for calculating a center position of the printing sheet based on the detected left and right edge positions, a carriage moving control circuit for controlling the movement of the carriage, and a feed control circuit for controlling a line feed operation. The sensor moves with the carriage and outputs a sensed signal based on the sensed result. The detector detects the left edge position and the right edge position of the printing sheet responsive to the sensed signal, and generates left edge position data and right edge position data associated with the detected positions. The calculating circuit calculates the center position of the printing sheet based on the left and right edge position data and generates a center position data associated with the center position. The carriage moving control circuit moves the carriage to the center position of the printing sheet based on the center position data. The feed control circuit performs the line feed after the movement of the carriage to the center position.

The serial printing according to the present invention comprises a platen, a carriage having a printing head secured thereto, a platen driver for rotating the platen, a carriage moving device for moving the carriage parallel to the longitudinal axis of the platen, and the above carriage position control circuit. The serial printer senses the left and right edges of the printing sheet with the sensor fixed to the carriage, and generates the left and right edge position data at the detector. The moving range of the carriage during a printing operation can be limited within the edges by using the left and right edge position data.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENTS

Figure 1:
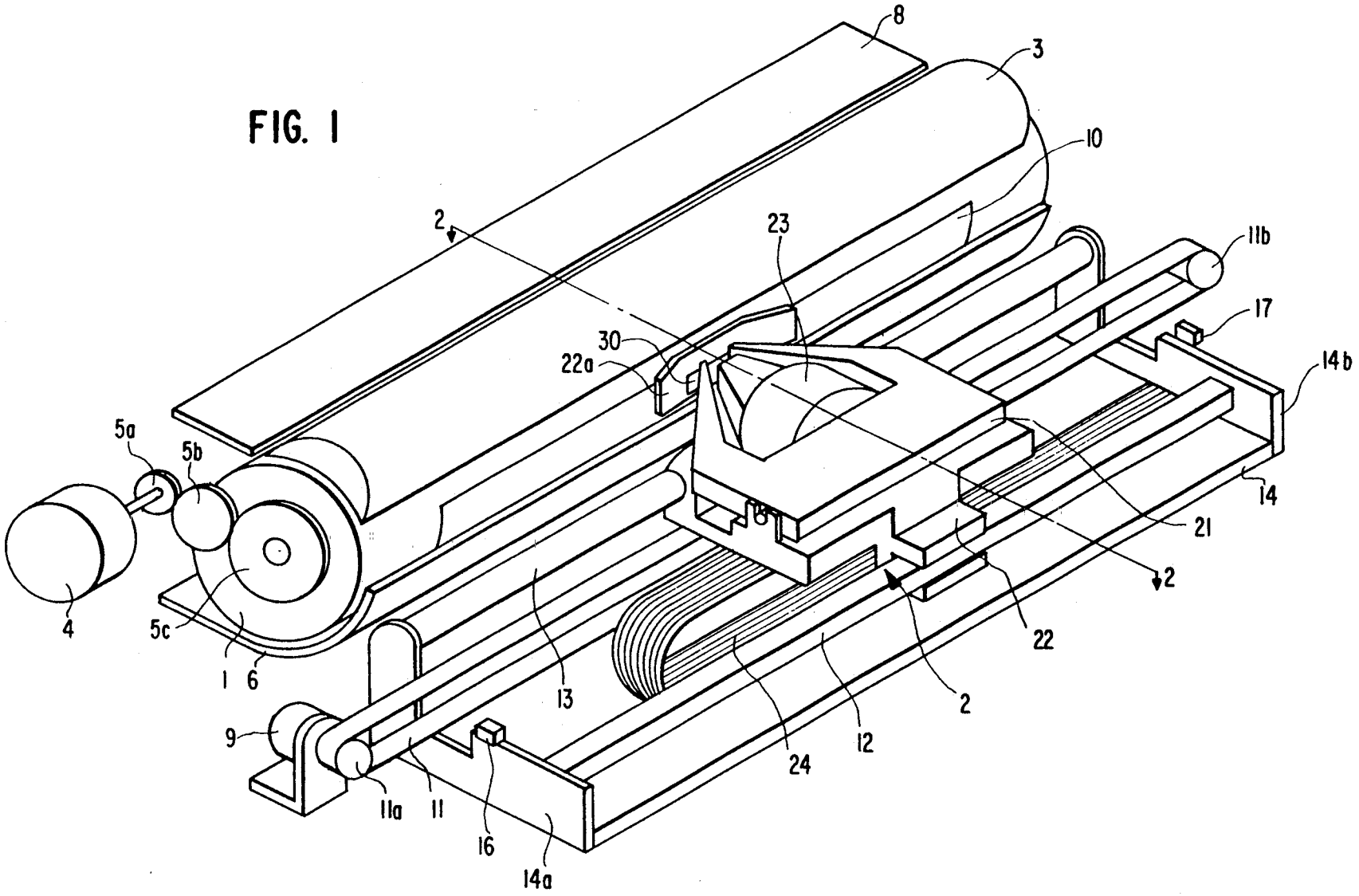
FIG. 1 is a perspective view of a mechanism of a serial printer according to a preferred embodiment of the present invention.
Figure 2:
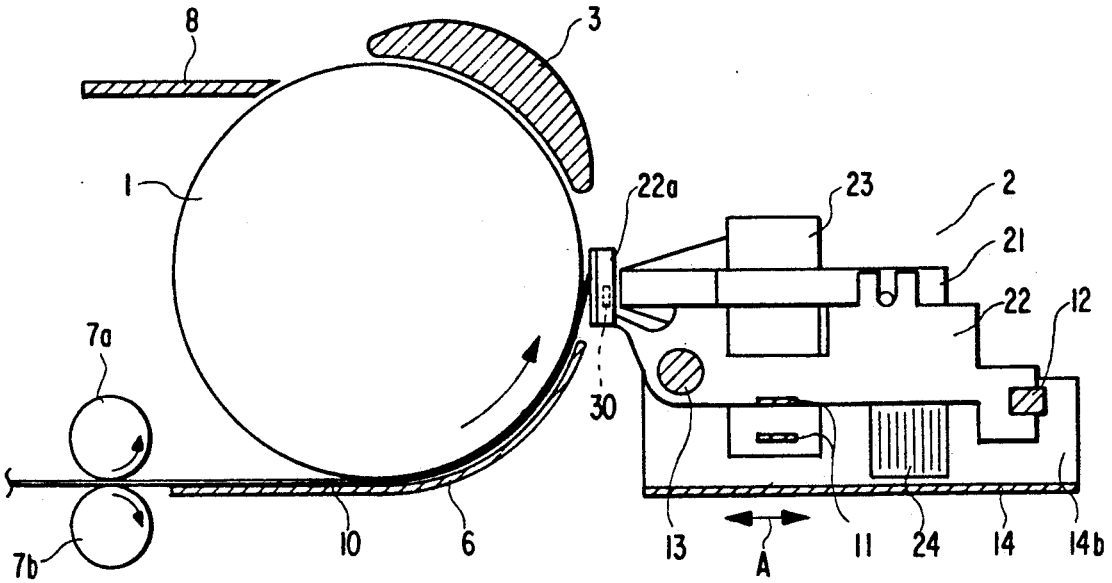
FIG. 2 is a cross-sectional view taken along line 2—2 of FIG. 1.

FIGS. 1 and 2 show a serial printer according to the present invention. The serial printer has a platen or platen roller 1, carriage 2 and an anti-floating device 3 disposed above the platen 1. A motor 4 rotates the platen 1 via gears 5*a*, 5*b* and 5*c* to feed a printing sheet 10. The motor 4 and the gears 5, 5*b* and 5*c* constitute the platen driving means. A guide plate 6 is located below the platen 1 defining a gap therebetween. Conveying rollers 7*a* and 7*b* feed the printing sheet 10 through the gap so that the printing sheet 10 is carried by the platen 1 to an initial position described hereinafter. Between the lower end of the anti-floating device 3 and the upper end of the guide plate 6 is a space for printing characters on the printing sheet 10 using a head disposed on the carriage 2. The anti-floating device 3 is slightly displaced from the platen 1 so as to define a narrow space therebetween so that the printing sheet 10 is maintained in contact with the platen 1. Rotation of the platen eventually causes the printing sheet 10 to be fed onto a guide 8.

The carriage 2 is fixed to an endless belt 11 which is located parallel to the platen 1 and is disposed between the motor pulley 11*a* and another pulley 11*b*. A motor 9 rotates the endless belt 11 to move the carriage 2 along the platen. The endless belt 11, pulleys 11*a*, 11*b* and the motor 9 constitute the carriage moving means. Guide rods 12 and 13 extending parallel to the platen slidably support the carriage 2. The guide rods are fixed to opposing side plates 14*a* and 14*b* of a base plate 14.

The carriage 2 includes a carriage base 22 on which are disposed a ribbon cartridge 21 and a print head 23. The print head 23 is connected to a cable 24 through which a head drive signal is supplied to the print head. The carriage base 22 is attached to the endless belt 11 and is slidably disposed on the guide rods 12 and 13. A sheet holder 22*a* is secured to the carriage base at a location in front of the head 23 and both sides of the sheet holder 22*a* are bent backwardly toward the head, as illustrated in FIG. 1. A reflection type photosensor 30 is fixed on the sheet holder 22*a* to sense the presence of a printing sheet 10. The photosensor 30 is included in a carriage position control circuit according to the present invention, as discussed in greater detail below.

Figure 3:
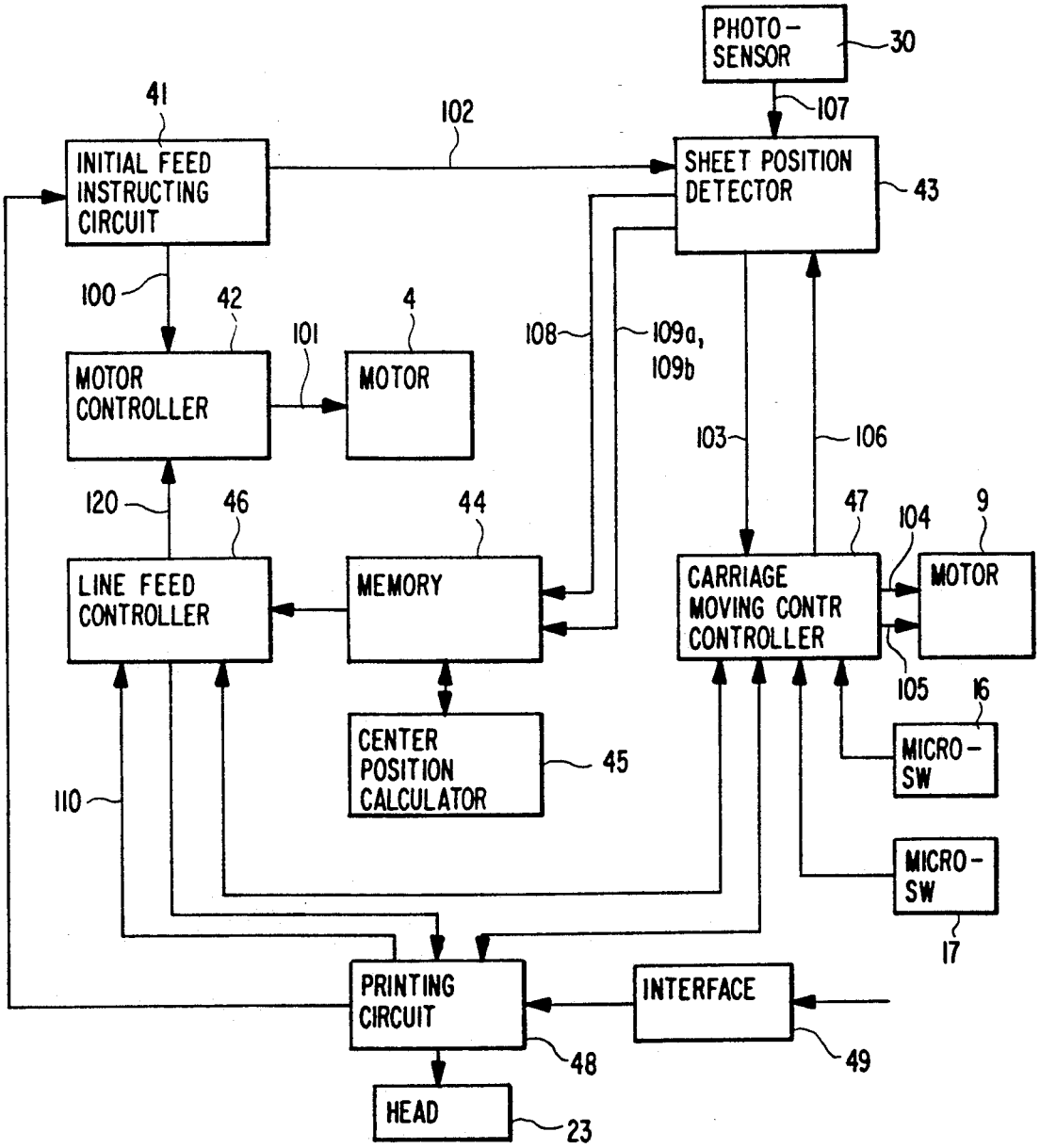
FIG. 3 is a block diagram of a carriage position control circuit and a printing circuit used in the serial printer according to the preferred embodiment.

FIG. 3 is a block diagram of the carriage position control circuit and printing circuit provided with the serial printer shown in FIGS. 1 and 2.

In FIG. 3, an initial feed instructing circuit 41 activates the motor controller 42 in response to a start signal received from a printing circuit 48 to drive the motor 4 until the leading edge of the printing sheet 10 reaches an initial position as shown in FIGS. 1 and 2. A sheet position detector 43 receives the output of the photosensor 30 and, in the manner described below, detects the positions of a right edge and a left edge of the printing sheet 10 located at the initial position, and then outputs the left and right edge position data to a memory 44. A center position calculator 45 calculates a center position of the printing sheet based on the left and right edge position data and stores the center position data in the memory 44. The memory 44 and the center position calculator 45 constitute calculating means for calculating the center position. A line feed controller 46 reads the center position data to control a carriage moving controller 47 and the motor controller 42 so that the carriage 2 is moved to the center position of the printing sheet 10 at which time sheet feeding begins before the printing sheet 10 is fed to the anti-floating device.

Figure 5:
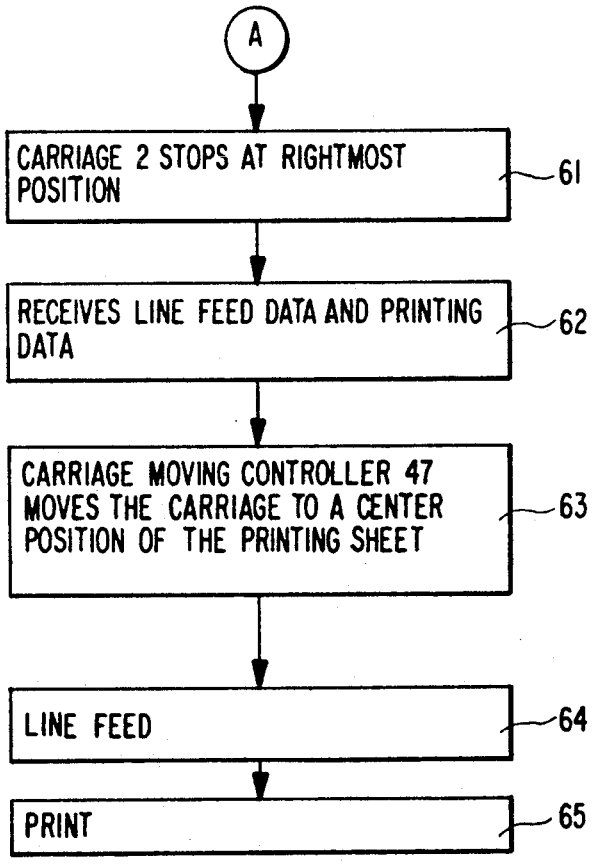
Figure 6:
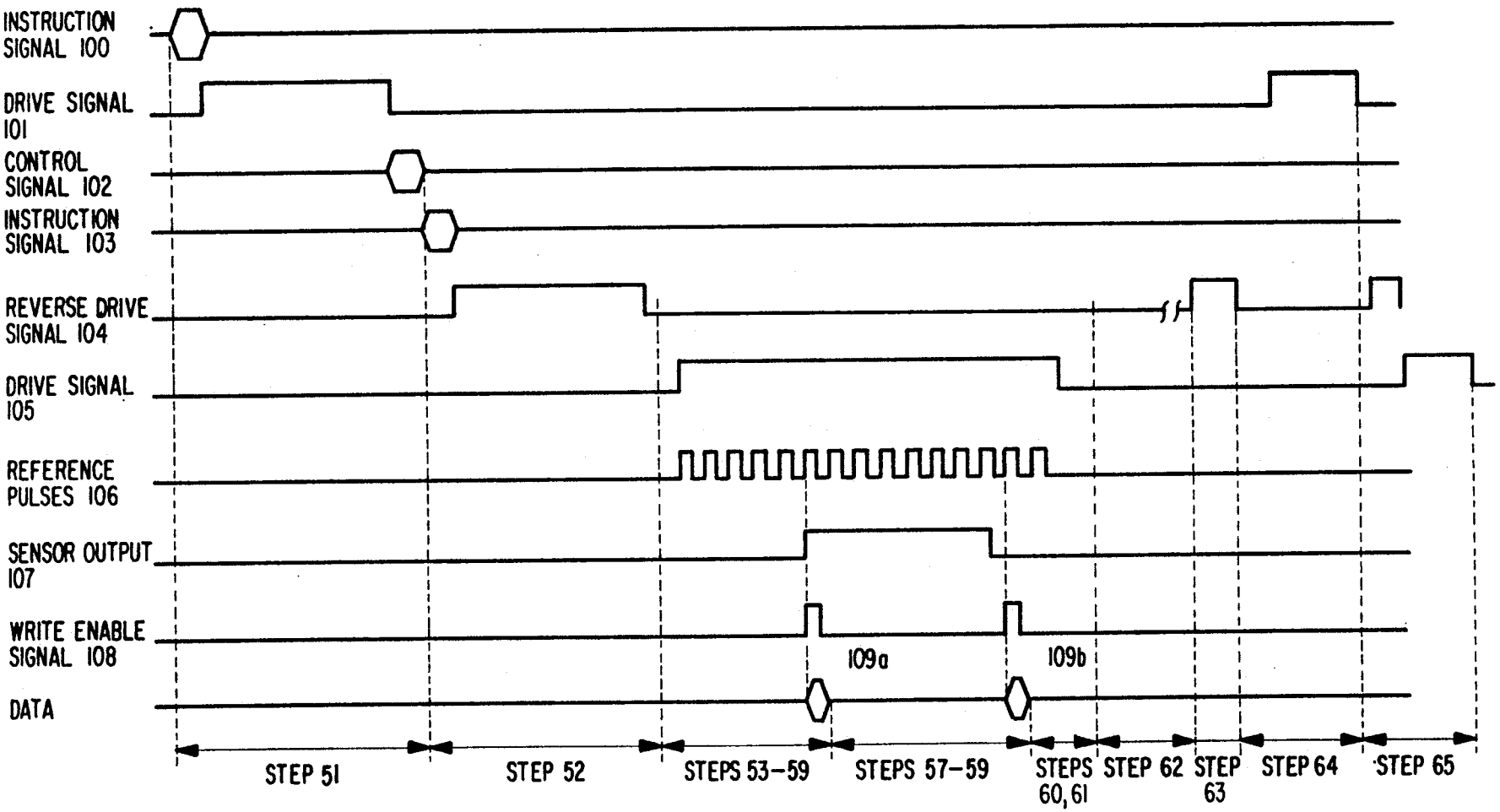
FIG. 6 is a timing chart showing an operation of the carriage position control circuit and the printing circuit of FIG. 3.

An operation of the carriage position control circuit in FIG. 3 will be described in detail with reference to flow charts shown in FIGS. 4 and 5 and a timing chart shown in FIG. 6.

First, the initial feed constructing circuit 41 generates an instruction signal 100 after receiving the start signal from the printing circuit 48 and supplies it to the motor controller 42 to execute an initial sheet feed (step 51). The motor controller 42 generates a drive signal 101 in response to the instruction signal 100 and drives the motor 4 to thereby feed the sheet. When the drive signal 101 is a high level or a "1", the motor 4 continuously rotates the platen 1. The drive signal 101 continues the high level until the leading edge of the printing sheet 10 reaches an initial position where the sensor 30 detects the arrival of the sheet.

After the initial positioning of the printing sheet 10, the initial feed instruction circuit 41 outputs a control signal 102 to the sheet position detector 43. The sheet position detector 43 generages an instruction signal 103 in response to the control signal 102 and supplies the instruction signal to the carriage moving controller 47 to move the carriage 2 toward a leftmost position (step 52). Specifically, in response to the instruction signal 103, the carriage moving controller 47 generates a drive signal 104 to rotate the stepping motor 9 until the carriage 2 activates the microswitch 16 at the leftmost position. When the carriage 2 activates the microswitch 17 at the leftmost position, the drive signal 104 becomes low and then a reverse drive signal 105 is output from the carriage moving controller 47 to move the carriage 2 to the right-most side (step 53). While the carriage moving controller 47 outputs the reverse signal 105, it supplies reference pulses 106 to the sheet position detector 43. A reference pulse is generated for each rotation of the stepping motor 9. The sheet position detector 43 counts the reference pulses 106 to detect the carriage position, and at the same time, detects a sensor output 107 at each reference pulse (step 54).

Figure 7:
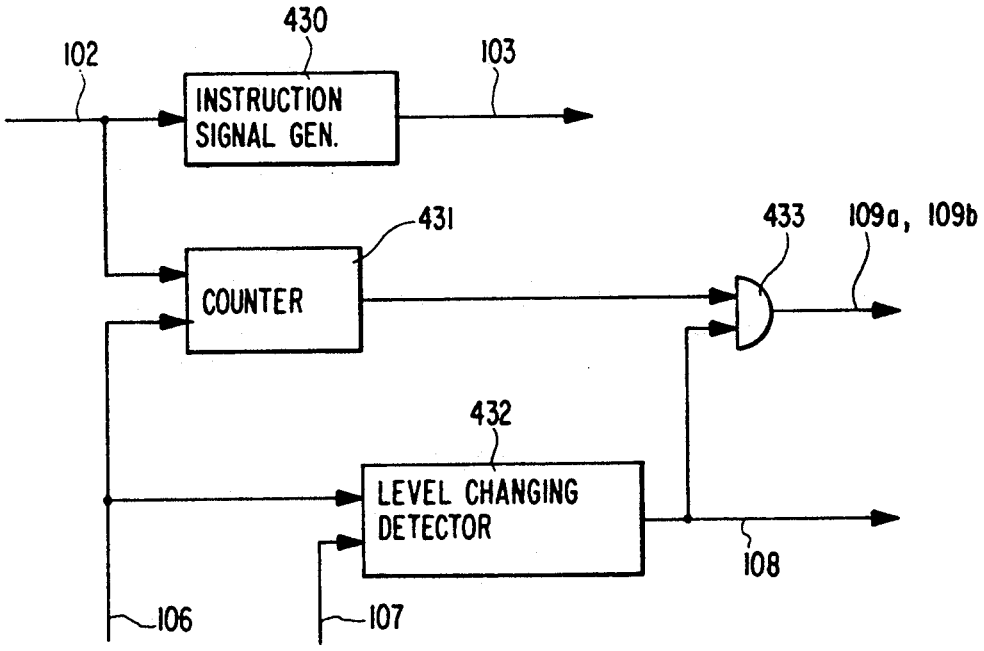
FIG. 7 is a block diagram of a sheet position detector used in the carriage position control circuit of FIG. 3.

FIG. 7 is a block diagram of the sheet position detector 43. In FIG. 7, an instruction signal generator 430 generates the instruction signal 103 in response to the control signal 102. A counter 431 is activated by the control signal 102 and counts the reference pulses 106. A level changing detector 432 detects the level of the sensor output 107 for each reference pulse 106, and when the level is changed, it generates a write enable pulse 108 to the memory 44. When the pulse 108 is generated, the count value of the counter 431 passes through an AND gate 433 as left edge and right edge position data 109*a* and 109*b*.

Figure 4:
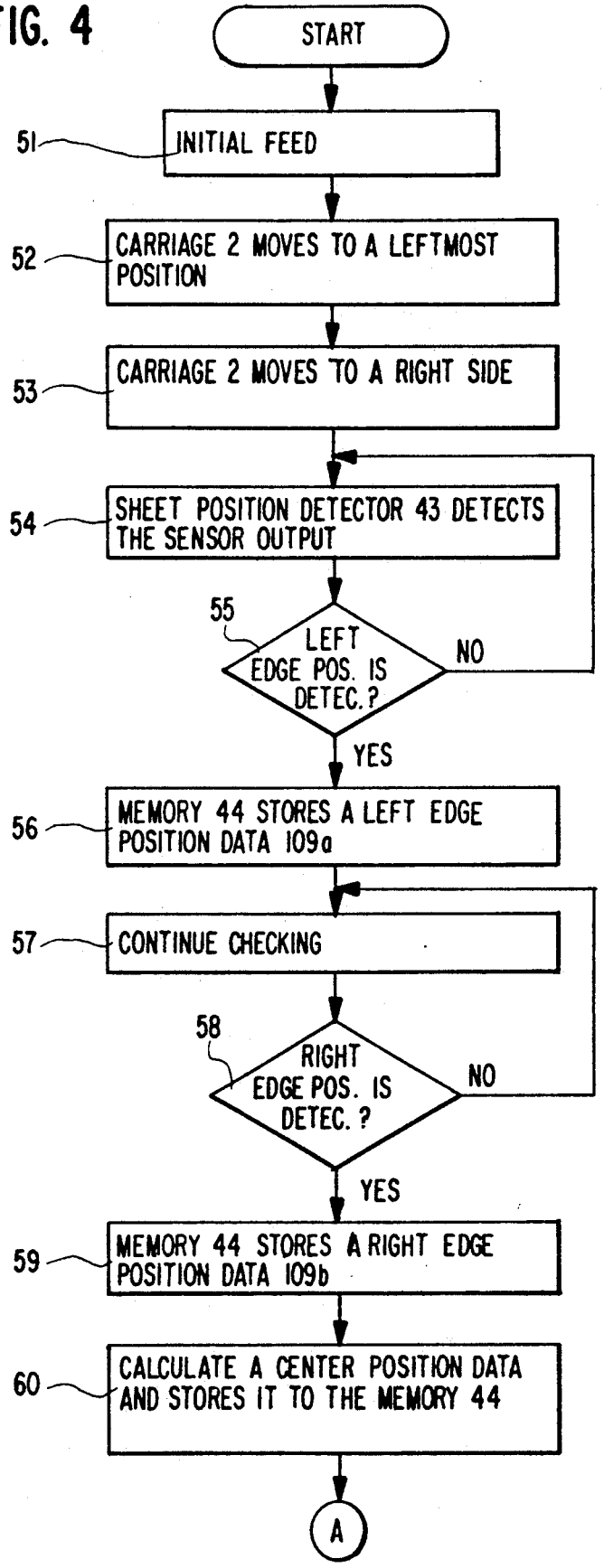
FIGS. 4 and 5 are flow charts showing an operation of the carriage position control circuit and the printing circuit of FIG. 3.

Therefore, in step 54 of FIG. 4, when the sensor 30 detects the left edge of the printing sheet 10 (step 55) and the sensor output 107 turns to a high level, the sheet position detector 43 outputs the count value of the reference pulses 106 as the left edge position data 109*a* and supplies it to the memory 44 with a write enable pulse 108 (step 56). The sheet position detector 43 continues to check the sensor output 107 for each reference pulse 106 (step 57), and when the sensor 30 detects the right edge of the printing sheet 10 (step 58) and the sensor output 107 turns to a low level, the sheet position detector 43 outputs the count value of the reference pulse 106 as the right edge position data 109*b* and supplies it to the memory 44 with the write enable pulse 108 (step 59). The memory 44 stores the left and right edge position data 109*a* and 109*b* in predetermined addresses respectively.

Thereafter, the center position calculator 45 reads the left and right edge position data 109*a* and 109*b* and calculates a center position data by calculating an average of the data 109*a* and 109*b* and then stores the center position data in the memory 44. When the carriage 2 reaches the rightmost position (see Step 61 of FIG. 5), the microswitch 17 is activated by the carriage 2 and the carriage moving controller 47 stops the reverse drive signal 105 in response to the output of the microswitch 17. The printing circuit 48 receives line feed data and printing data from the interface 49 (step 62). Then, the printing circuit 48 supplies instruction signal 110 to the line feed controller 46, and the line feed controller 46 reads the center position data from the memory 44 and outputs it to the carriage moving controller 7. Since the center position data represents the number of rotation steps of the stepping motor 9 to move the carriage 2 from the leftmost position to the center position of the printing sheet 10, the carriage moving controller 47 generates the driving signal 104 based on the center position data. Therefore, the carriage 2 is moved to the center position of the printing sheet 10 so that the sheet holder 22*a* (see FIG. 1) can maintain the printing sheet in contact with the platen 1 (step 63).

After moving the carriage 2 to the center position, the carriage moving controller 47 controls the line feed controller 46 which in turn controls the line feed operation by controlling the motor controller 42 via a control signal 120 (step 64). After step 64 in FIG. 5, the line feed, carriage movement and printing by the head 23 is controlled by the printing circuit (step 65). Since the left and right edge positions of the printing sheet 10 are detected and stored in the memory 44, the printing circuit 48 controls the carriage moving controller 47 by reading the left and right edge position data via the line feed controller 46 so that the controller 47 drives the motor 9 to move the carriage 2 between the left and right edge positions while the printer prints characters on the printing sheet. Therefore, the moving time of the carriage 2 is reduced.

As described above, according to the present invention, the photosensor moves, together with the carriage, in parallel to the axis of the platen of the serial printer and the sheet position detector detects the left and right edge positions of the sheet from the sensor output of the photosensor. From the thus detected left and right positions of the sheet, the center position calculator calculates the center position of the printing sheet. The detection of the left and right edge positions and the subsequent calculation of the center position are performed before the leading edge of the printing sheet reaches the anti-floating device. Therefore, it is possible to reliably move the carriage to the center position of the printing sheet and then feed the line stably even if the width of the printing sheet is very narrow compared with the length of the platen. Thus, the printing sheet can be prevented from being raised from the platen. Further, in a case where the printing sheet are frequently changed to sheets having different widths or the sheets are placed at different positions on the platen, it is not necessary for the operator to change the position of the carriage manually.

It will be appreciated that modifications may be made to the present invention. For example, in FIG. 1, although the carriage 2 is moved by rotating the endless belt 11, a shaft gear can be used instead of the endless belt. The shaft gear is used in many conventional printers.

Although the present invention has been fully described by way of the preferred embodiments thereof with reference to the accompanying drawings, various changes and modifications will be apparent to those having skill in this field. Therefore, unless these changes and modifications otherwise depart from the scope of the present invention, they should be construed as included therein.

What is claimed is:

1. A carriage position control circuit for use in a serial printer which includes a platen for feeding a printing sheet and a printing head carriage movable in a direction parallel to a longitudinal axis of said platen, for positioning said carriage before performing a line feed operation, said control circuit comprising:

sensing means, which moves with said carriage for sensing the presence of the printing sheet set in an initial position on said platen and for outputting a sensed signal based on the sensed result;

detecting means for detecting a left edge position and a right edge position of the printing sheet responsive to said sensed signal, and generating left edge position data and right edge position data associated with said detected positions;

means for calculating a center position of the printing sheet based on said left and right edge position data and generating a center position data associated with the center position;

carriage moving control means for moving said carriage to the center position of the printing sheet based on said center position data; and feed control means for performing said line feed after the movement of said carriage to the center position.

2. The carriage position control circuit of claim 1, wherein said sensing means senses the printing sheet while said carriage moves parallel to the longitudinal axis of said platen.

3. The carriage position control circuit of claim 1, wherein said calculating means comprises storing means for storing said left and right edge position data and center position calculating means for calculating the center position based on said left and right edge position data.

4. A serial printer, comprising:

a platen for feeding a printing sheet;

a carriage including a printing head secured thereto and being movable parallel to a longitudinal axis of said platen;

platen driving means for rotating said platen to feed the printing sheet;

carriage moving means for moving said carriage parallel to the longitudinal axis of said platen;

sensing means, which moves with said carriage, for sensing the presence of the printing sheet set in an initial position on said platen and outputting a sensed signal based on the sensed result;

detecting means for detecting a left edge position and a right edge position of the printing sheet responsive to said sensed signal, and generating left edge position data and right edge position data associated with said detected positions;

means for calculating a center position of the printing sheet based on said left and right edge position data and generating a center position data associated with the center position;

carriage moving control means for controlling said carriage moving means to move said carriage to the center position of the printing sheet based on said center position data; and feed control means for controlling said platen driving means to perform a line feed operation after the movement of said carriage to the center position.

5. The serial printer of claim 4, wherein said platen driving means initially rotates said printing sheet to position said printing sheet in said initial position.

6. The serial printer of claim 5, wherein said sensing means senses the printing sheet when said carriage is moved parallel to the center axis of said platen by said carriage moving means.

7. The serial printer of claim 4, wherein said calculating means comprises storing means for storing said left and right edge position data, and center position calculating means for calculating the center position based on said left and right edge position data.

8. The serial printer of claim 4, further comprising an anti-floating device for preventing the printing sheet from being displaced from the platen, and a sheet holder fixed to said carriage for maintaining the printing sheet in contact with said platen before the printing sheet is fed to said anti-floating device.

9. The serial printer claimed in claim 8, wherein said sensing means is fixed to said sheet holder.

10. The serial printer claimed in claim 4, wherein said sensing means is a photosensor.

* * * * *